US007183244B2

(12) United States Patent
Tamura et al.

(10) Patent No.: US 7,183,244 B2
(45) Date of Patent: Feb. 27, 2007

(54) DETERGENT COMPOSITIONS COMPRISING A MIXTURE OF PHOSPHATE ESTERS

(75) Inventors: Yoshinori Tamura, Wakayama (JP); Ryosuke Fujii, Wakayama (JP); Tomoko Uchiyama, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 11/017,847

(22) Filed: Dec. 22, 2004

(65) Prior Publication Data

US 2005/0159331 A1 Jul. 21, 2005

(30) Foreign Application Priority Data

Dec. 26, 2003 (JP) ..... 2003-433864

(51) Int. Cl.
*C11D 1/72* (2006.01)
*C11D 7/36* (2006.01)

(52) U.S. Cl. ..... 510/122; 510/119; 510/128; 510/130; 510/150; 510/421; 510/423; 510/431; 510/436; 510/467

(58) Field of Classification Search ..... 510/119, 510/122, 128, 130, 150, 421, 423, 431, 436, 510/467
See application file for complete search history.

(56) References Cited

U.S. PATENT DOCUMENTS

| | | | | |
|---|---|---|---|---|
| 3,957,661 | A * | 5/1976 | Verite | 510/308 |
| 5,372,743 | A * | 12/1994 | Miyamoto et al. | 510/245 |
| 6,525,005 | B1 * | 2/2003 | Kravitz et al. | 508/438 |
| 6,667,283 | B2 * | 12/2003 | Kravitz et al. | 508/438 |

FOREIGN PATENT DOCUMENTS

| | | |
|---|---|---|
| EP | 0 496 359 A1 | 7/1992 |
| EP | 1 221 474 A1 | 7/2002 |
| JP | 2001-181677 | 7/2001 |

OTHER PUBLICATIONS

Patent Abstracts of Japan, JP 2001-107079, Apr. 17, 2001.

* cited by examiner

*Primary Examiner*—Charles Boyer
(74) *Attorney, Agent, or Firm*—Oblon, Spivak, McClelland, Maier & Neustadt, P.C.

(57) ABSTRACT

Provided is a detergent composition having components (A) and ($B_1$): (A) a phosphate monoester (1), and ($B_1$) a phosphate monoester (2), wherein n=1; components (A), ($B_1$) and ($B_2$): (A) a phosphate monoester (1), ($B_1$) a phosphate monoester (2), wherein n=1, and ($B_2$) a phosphate monoester (2), wherein n=2; components (A), ($B_1$) and ($B_2$): (A) a phosphate monoester (1), ($B_1$) a phosphate monoester (2), wherein n=1, and ($B_2$) a phosphate monoester (2), wherein n=2; components (A) and (C): (A) a phosphate monoester (1), and (C) a phosphate monoester (3); or a phosphate-based surfactant produced by reacting a compound obtained by adding to an alcohol an alkylene oxide of 2 to 4 carbon atoms, with phosphoric acid, a polyphosphoric acid or $P_2O_5$:

(1)

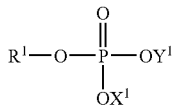

(2)

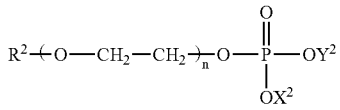

(3)

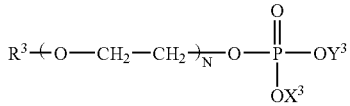

The detergent composition is mild to the skin, is high in versatility, and has a good foaming property in weak acidic water or in hard water.

12 Claims, No Drawings

DETERGENT COMPOSITIONS COMPRISING A MIXTURE OF PHOSPHATE ESTERS

FIELD OF THE INVENTION

The present invention relates to a detergent composition, and specifically to detergent compositions which have benefits such as being little irritant to the skin, having a good foaming property, having a high versatility and having a good foaming property in water having a weak acidic range or in hard water.

BACKGROUND OF THE INVENTION

Detergent compositions which directly contact skin such as shampoos, body detergents and the like are required to cause little irritation to the skin in addition to having detergency, foaming performance and good feel upon use. Sulfate-type surfactants, which have been widely used as a detergent component, are high in foaming performance, but sometimes irritate the eyes during shampooing and are liable to roughen hands and skin of the person having sensitive skin over long-term use. Detergent compositions containing as a main component a so-called low irritating surfactant such as an acetate-type surfactant, an amphoteric surfactant, or a surfactant having a sugar skeleton are poor in detergent effect and foaming power, thereby failing to give a satisfactory detergent. Phosphate ester-based surfactants, a kind of anionic surfactant, cause lowered irritation to the skin or the like and are known as a mild surfactant. However, the phosphate ester-based surfactants have a problem that they are poor in water solubility in a certain pH range and in hard water, and are poor in foaming power although their detergency is satisfactory. Phosphate esters having ethylene oxide introduced thereto to improve water solubility are known (for example, JP2001-107079 A and JP 2001-181677 A). Although the ethylene oxide-introduced phosphate esters are improved in solubility compared with phosphate esters not having ethylene oxide, their foaming power is insufficient. Therefore, detergent compositions containing the ethylene oxide-introduced phosphate esters or the phosphate esters not having ethylene oxide have a problem that they are low in versatility, specifically they are poor in foaming in a wide range of pH, foaming in hard water and in sebum resistance.

SUMMARY OF THE INVENTION

The present invention relates to a detergent composition which has benefits such as being little irritant to the skin, having a good foaming property, having a high versatility and having a good foaming property even in water having a weak acidic range or in hard water.

The present invention provides a detergent composition which contains the following components (A) and ($B_1$) in a molar ratio of component (A) to component ($B_1$), (A)/($B_1$), in a range of from 70/30 to 90/10 (hereinafter, referred to as detergent composition 1):

(A) a phosphate monoester represented by general formula (1), and ($B_1$) a phosphate monoester represented by general formula (2), wherein n is 1, (1)

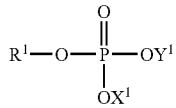

(2)

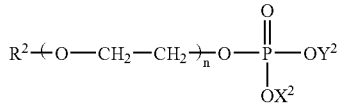

wherein, $R^1$ and $R^2$ may be the same or different and each represents a straight or branched alkyl or alkenyl group having 8 to 18 carbon atoms; $X^1$, $X^2$, $Y^1$ and $Y^2$ may be the same or different and each represents a hydrogen atom, an alkali metal atom, an alkaline earth metal atom, an alkanolamine or ammonium; and n, a molar number of ethylene oxides added, is an integer of not less than 1.

The present invention also provides a detergent composition which contains the following components (A), ($B_1$) and ($B_2$) in amounts of 35~80 molar % of component (A), 15~25 molar % of component ($B_1$) and 5~15 molar % of component ($B_2$) in the phosphate monoesters represented by formulas (1) and (2) (hereinafter, referred to as detergent composition 2):

(A) a phosphate monoester represented by general formula (1), ($B_1$) a phosphate monoester represented by general formula (2), wherein n is 1, and (B2) a phosphate monoester represented by general formula (2), wherein n is 2

(1)

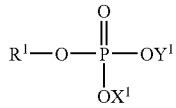

(2)

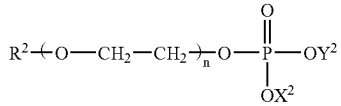

wherein, $R^1$ and $R^2$ may be the same or different and each represents a straight or branched alkyl or alkenyl group having 8 to 18 carbon atoms; $X^1$, $X^2$, $Y^1$ and $Y^2$ may be the same or different and each represents a hydrogen atom, an alkali metal atom, an alkaline earth metal atom, an alkanolamine or ammonium; and n, a molar number of ethylene oxides added, is an integer of not less than 1.

The present invention further provides a detergent composition which contains the following components (A), ($B_1$) and ($B_2$) in amounts of 5~30 wt. % of component (A), 1~10 wt. % of ($B_1$) and 0.5~5 wt. % of ($B_2$) in the detergent composition (hereinafter, referred to as detergent composition 3):

(A) a phosphate monoester represented by general formula (1), ($B_1$) a phosphate monoester represented by general formula (2), wherein n is 1, and (B2) a phosphate monoester represented by general formula (2), wherein n is 2

(1)

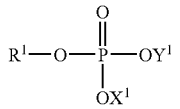

(2)

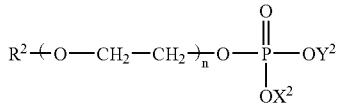

wherein, $R^1$ and $R^2$ may be the same or different and each represents a straight or branched alkyl or alkenyl group having 8 to 18 carbon atoms; $X^1$, $X^2$, $Y^1$ and $Y^2$ may be the same or different and each represents a hydrogen atom, an alkali metal atom, an alkaline earth metal atom, an alkanolamine or ammonium; and n, a molar number of ethylene oxides added, is an integer of not less than 1.

The present invention still further provides a detergent composition which contains the following components (A) and (C) in amounts of 5~60 parts by weight of component (A) and 40~95 parts by weight of component (C) of the total amount of components (A) and (C) which total is 100 parts by weight (hereinafter, referred to as detergent composition 4):

(A) a phosphate monoester represented by general formula (1), and (C) a phosphate monoester represented by general formula (3), (1)

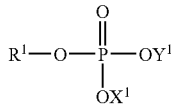

(3)

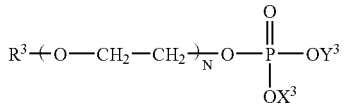

wherein, $R^1$ and $R^3$ may be the same or different and each represents a straight or branched alkyl or alkenyl group having 8 to 18 carbon atoms; $X^1$, $X^3$, $Y^1$ and $Y^3$ may be the same or different and each represents a hydrogen atom, an alkali metal atom, an alkaline earth metal atom, an alkanolamine or ammonium; and N, an average molar number of ethylene oxides added, is a number of from 1 to 2.

The present invention still further provides a detergent composition which contains a phosphate-based surfactant produced by reacting a compound obtainable by adding an alkylene oxide of 2 to 4 carbon atoms in an amount of 0.3 to 0.8 in terms of average molar number of the alkylene oxide added to 1 mole of an alcohol having a straight or branched alkyl or alkenyl group having 8 to 18 carbon atoms with phosphoric acid, a polyphosphoric acid or $P_2O_5$ (hereinafter, referred to as detergent composition 5).

DETAILED DESCRIPTION OF THE INVENTION

The detergent composition according to the present invention has many benefits such as being mild to the skin and having a good foaming property in water having a weak acidic range or in hard water.

The present inventors have performed extensive research on phosphate monoester-based surfactants and found that a phosphate monoester represented by general formula (1) and an ethylene oxide-added phosphate monoester represented by general formula (2) exhibit synergistic effects in foaming power and maintain high foaming power particularly in hard water and in weak acidic water when these phosphate monoesters are mixed in a specific ratio.

Conventional phosphate monoester-based surfactants are mixtures of monoesters and diesters. As the materials used as a phosphate monoester in the present invention, those having a low diester content are preferred from the view point of foamability. However, it is difficult to produce such a material having a diester content of 0. Accordingly, the weight ratio of a monoester to a diester (monoester/diester) in the detergent composition according to the present invention is preferably from 100/0 to 60/40, more preferably from 99/1 to 70/30, even more preferably from 99/1 to 75/25, and even more preferably from 99/1 to 80/20.

In general formulas (1)~(3), the number of carbon atoms contained in $R^1$, $R^2$ and $R^3$ is preferably from 8 to 18, more preferably from 10 to 16, and even more preferably from 12 to 14 in view of versatility and foamability. $R^1$, $R^2$ and $R^3$ may be straight or branched, but are preferably straight in view of foam quality. $X^1$, $X^2$, $X^3$, $Y^1$, $Y^2$ and $Y^3$ are preferably a hydrogen atom, an alkali metal atom such as potassium, sodium or lithium, or an alkanolamine such as triethanolamine or diethanolamine in view of foamability and lowered irritation. They are more preferably potassium, sodium or triethanol amine, and even more preferably potassium or sodium.

In detergent composition 1 containing components (A) and ($B_1$), the molar ratio of component (A) to component ($B_1$) is preferably from 70/30 to 90/10, more preferably from 70/30 to 85/15, and even more preferably from 75/25 to 80/20 in view of foamability and enhancing versatility.

In detergent composition 2 containing components (A), ($B_1$) and ($B_2$), the molar ratios of components (A), ($B_1$) and ($B_2$) in the phosphate monoesters represented by formulas (1) and (2) are preferably (A) 35~80 molar %, ($B_1$) 15~25 molar % and ($B_2$) 5~15 molar %, more preferably (A) 50~80 molar %, ($B_1$) 16~24 molar % and ($B_2$) 6~13 molar %, and even more preferably (A) 60~75 molar %, ($B_1$) 17~22 molar % and ($B_2$) 8~12 molar % in view of foamability and enhancing versatility.

In detergent composition 3 containing components (A), ($B_1$) and ($B_2$), the contents of components (A), ($B_1$) and ($B_2$) in the detergent composition are preferably (A) 5~30 wt. %, ($B_1$) 1~10 wt. %, and ($B_2$) 0.5~5 wt. %, more preferably (A) 10~20 wt. %, ($B_1$) 2~8 wt. %, and ($B_2$) 0.5~5 wt. %, and even more preferably (A) 12~18 wt. %, ($B_1$) 2~6 wt. %, and ($B_2$) 1~3 wt. % in view of foamability and enhancing versatility.

In detergent composition 4 containing components (A) and (C), the amounts of components (A) and (C) in the detergent composition are preferably (A) 5~60 parts by weight and (C) 40~95 parts by weight, more preferably (A) 10~60 parts by weight and (C) 40~90 parts by weight, and even more preferably (A) 20~50 parts by weight and (C) 50~80 parts by weight in view of foamability and enhancing versatility.

Detergent compositions 1, 2, 3, 4 and 5 preferably further contain a glyceryl ether having 4 to 12 carbon atoms, more preferably 6 to 10 carbon atoms in view of foamability.

The content of the glyceryl ether in these compositions is preferably from 0.3 to 5 wt. %, more preferably from 0.5 to 3 wt. %, and even more preferably from 0.8 to 2 wt. % in view of foamability.

Detergent compositions 1, 2, 3, 4 and 5 have a pH preferably in a range of from 4 to 8, more preferably from 5 to 7 when diluted 20 times with water in view of lowered irritation. The pH may be adjusted by using an acid such as lactic acid, succinic acid, malic acid, citric acid, hydrochloric acid, phosphoric acid, sulfuric acid or the like, or an alkali such as an alkali metal hydroxide, ethanolamine or the like. Incidentally, the pH is a value measured at 25° C.

Detergent compositions 1, 2, 3, 4 and 5 can be used with water having a pH preferably in a range of from 4 to 9, more preferably from 5 to 8. Incidentally, the pH is a value measured at 25° C.

Detergent compositions 1, 2, 3, 4 and 5 can be used with water having a hardness preferably in a range of from 1 to 30° DH, more preferably from 4 to 20° DH.

Detergent compositions 1, 2 and 3 can be prepared by, for example, mixing in an appropriate ratio (A) a phosphate monoester obtained by reacting a corresponding aliphatic alcohol with a phosphorylating agent such as anhydrous phosphoric acid, polyphosphoric acid or the like, ($B_1$) a phosphate monoester of formula (2) wherein n is 1 obtained, for example, by reacting a corresponding monoethyleneglycol monoalkyl ether with a phosphorylating agent such as phosphorus oxychloride, and ($B_2$) a phosphate monoester of formula (2) wherein n is 2 obtained, for example, by reacting a corresponding diethyleneglycol monoalkyl ether with a phosphorylating agent such as phosphorus oxychloride, and then neutralizing the mixture with an alkali such as sodium hydroxide, potassium hydroxide or the like.

Alternatively, detergent compositions 1, 2, 3 and 4 can be prepared by mixing in an appropriate ratio (A) a phosphate monoester obtained, for example, by reacting a corresponding aliphatic alcohol with a phosphorylating agent such as anhydrous phosphoric acid, polyphosphoric acid, phosphorus oxychloride or the like, and (C) a polyoxyethylene phosphate monoester obtained, for example, by adding ethylene oxide to a corresponding aliphatic alcohol to give an ethoxylate having an average molar number of ethylene oxide added of 1 to 2 and then reacting the ethoxylate with a phosphorylating agent such as anhydrous phosphoric acid, polyphosphoric acid or phosphorus oxychloride, and then neutralizing the resulting mixture with an alkali such as sodium hydroxide, potassium hydroxide or the like. Whether the resulting composition corresponds to the detergent composition 1, 2 or 3 can be confirmed by analysis such as gas chromatography by measuring the ratio of (A):($B_1$):($B_2$) in the composition.

Particularly, detergent composition 4 can be prepared by mixing 5 to 60 parts by weight of (A) a phosphate monoester represented by formula (1) obtained by reacting a corresponding aliphatic alcohol represented by formula (4) with at least one phosphorylating agent selected from phosphoric acid (also referred to as orthophosphoric acid, and so forth), polyphosphoric acid (also referred to as condensed phosphoric acids and so forth) and $P_2O_5$ (also referred to as anhydrous phosphoric acid, and so forth), and 40 to 95 parts by weight of (C) a polyoxyethylene phosphate monoester represented by formula (3) obtained by adding ethylene oxide to a corresponding aliphatic alcohol represented by formula (5) to give an ethoxylate having an average molar number of ethylene oxide added of 1 to 2 and reacting the ethoxylate with at least one phosphorylating agent selected from phosphoric acid, polyphosphoric acid and $P_2O_5$, and then neutralizing the resulting mixture with an alkali:

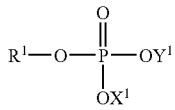

(1)

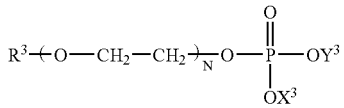

(3)

$R^1OH$ (4)

$R^3OH$ (5)

wherein, $R^1$, $R^3$, $X^1$, $X^3$, $Y^1$, $Y^3$ and N are as mentioned above.

Also, detergent compositions 1, 2, 3 and 5 can be prepared by neutralizing with an alkali such as sodium hydroxide, potassium hydroxide or the like a polyoxyethylene phosphate monoester having an average molar number of ethylene oxide added of 0.3 to 0.8 which is obtained, for example, by adding ethylene oxide to a corresponding aliphatic alcohol to give an ethoxylate having an average molar number of ethylene oxide added of 0.3 to 0.8 and then reacting the ethoxylate with a phosphorylating agent such as anhydrous phosphoric acid, polyphosphoric acid or the like. Whether the resulting composition corresponds to detergent composition 1, 2 or 3 can be confirmed by analysis such as gas chromatography by measuring the ratio of (A):($B_1$):($B_2$) in the composition.

Detergent composition 5, an embodiment of the present invention, contains a phosphate-based surfactant prepared by adding 0.3 to 0.8 mole, preferably 0.5 to 0.75 mole on average of an alkylene oxide of 2 to 4 carbon atoms, preferably of 2 carbon atoms to 1 mole of an alcohol having a straight or branched alkyl or alkenyl group of 8 to 18 carbon atoms, preferably 10 to 16 carbon atoms, more preferably 12 to 14 carbon atoms in view of foamability and enhancing versatility, and reacting the resulting compound with phosphoric acid, a polyphosphoric acid or $P_2O_5$. In the polyphosphoric acids ($P_2O_5.nH_2O$), preferred are those in which n is a number of from 1 to 2.

To the detergent composition according to the invention may be added, depending upon the purpose, conventional dyes, perfumes, bactericides, anti-inflammatory agents, chelating agents, foam-boosters, thickeners, viscosity regulators, pearling agents, antiseptics, humectants, pH regulators, other surfactants and the like as long as they do not impair the effect of the present invention.

The detergent composition according to the invention may be prepared by a conventional method, and the form thereof is not particularly restricted; they may be made into various forms conventionally known such as detergents for personal use, e.g., shampoos, facial washes, and body shampoos, or detergents for animals.

EXAMPLES

The following examples further describe and demonstrate embodiments of the present invention. The examples are given solely for the purpose of illustration and are not to be construed as limitations of the present invention.

Examples 1 to 7 and Comparative Examples 1 to 3

Detergent compositions containing the components as shown in Table 1 were prepared by mixing the components and the pH of the compositions were adjusted between 5 and 6. These compositions were evaluated with regard to quickness of foaming, amount of foam, quality of foam, and feel after washing according to the method described below by using water having a hardness of 4° DH and a pH of from 4 to 9. The results are shown in Table 1. Incidentally, the pH is a value measured at 25° C.

Examples 8 to 9 and Comparative Example 4

Detergent compositions containing the components as shown in Table 2 were prepared by mixing the components, and the pH of the compositions were adjusted between 5 and 6. These compositions were evaluated with regard to quickness of foaming, amount of foam, quality of foam, and feel after washing according to the method described below by using water having a hardness of 15° DH and a pH of from 4 to 9. The results are shown in Table 2. Incidentally, the pH is a value measured at 25° C.

Examples 10 to 13 and Comparative Example 5

Detergent compositions containing the components as shown in Table 3 were prepared by mixing the components, and the pH of the compositions were adjusted between 5 and 6. These compositions were evaluated with regard to quickness of foaming, amount of foam, quality of foam, and feel after washing according to the method described below by using water having a hardness of 4° DH and a pH of from 4 to 9. The results are shown in Table 3. Incidentally, the pH is a value measured at 25° C.

Examples 14 to 15 and Comparative Examples 6 to 7

Phosphate monoesters synthesized according to the method described below were neutralized with KOH, adjusted to have a pH of between 5 and 6, and evaluated with regard to quickness of foaming, amount of foam, quality of foam, and feel after washing according to the method described below by using water having a hardness of 15° DH and a pH of from 4 to 9. The results are shown in Table 4. Incidentally, the pH is a value measured at 25° C.

Examples 14 to 15

Phosphate monoester having 0.5 mole on average of EO added [polyoxyethylene(0.5)lauryl phosphate] which was synthesized as follows:

To a 500 mL reaction vessel were added under nitrogen atmosphere 209.3 g (1.0 mol) of a raw material alcohol (a lauryl alcohol to which 0.5 mole on average of EO is added) and 31.9 g of 85 wt. % orthophosphate (when expressed as $P_2O_5.nH_2O$, 19.6 g (0.14 mol) of $P_2O_5$ and 12.3 g (0.68 mol) of $H_2O$), and the mixture was mixed while stirring at 35° C. Further, 62.1 g (0.43 mol) of phosphorus pentoxide (active ingredient: 98.5 wt. %) was gradually added while stirring over 60 minutes. The temperature of the resulting mixture rose to 65° C., and the mixture was heated to effect reaction at 80° C. for 12 hours. Then 10.0 g of water was added thereto to effect hydrolysis at 80° C. for 3 hours.

Comparative Example 6

Phosphate monoester [lauryl phosphate] synthesized as follows:

To a 500 mL reaction vessel were added under nitrogen atmosphere 187.3 g (1.0 mol) of a raw material alcohol (lauryl alcohol) and 31.9 g of 85 wt. % orthophosphate (when expressed as $P_2O_5.nH_2O$, 19.6 g (0.14 mol) of $P_2O_5$ and 12.3 g (0.68 mol) of $H_2O$), and the mixture was mixed while stirring at 35° C. Further, 62.1 g (0.43 mol) of phosphorus pentoxide (active ingredient: 98.5 wt. %) was gradually added while stirring over 60 minutes. The temperature of the resulting mixture rose to 65° C., and the mixture was heated to effect reaction at 80° C. for 12 hours. Then 10.0 g of water was added thereto to effect hydrolysis at 80° C. for 3 hours.

Comparative Example 7

Phosphate monoester having 2 moles on average of EO added [polyoxyethylene(2)lauryl phosphate] which was synthesized as follows:

To a 500 mL reaction vessel were added under nitrogen atmosphere 275.4 g (1.0 mol) of a raw material alcohol (a lauryl alcohol to which 2 moles on average of EO is added) and 31.9 g of 85 wt. % orthophosphate (when expressed as $P_2O_5.nH_2O$, 19.6 g (0.14 mol) of $P_2O_5$ and 12.3 g (0.68 mol) of $H_2O$), and the mixture was mixed while stirring at 35° C. Further, 62.1 g (0.43 mol) of phosphorus pentoxide (active ingredient: 98.5 wt. %) was gradually added while stirring over 60 minutes. The temperature of the resulting mixture rose to 65° C., and the mixture was heated to effect reaction at 80° C. for 12 hours. Then 10.0 g of water was added thereto to effect hydrolysis at 80° C. for 3 hours.

[Evaluation Method]

Quickness of Foaming, Amount of Foam, Quality of Foam, and Feel after Washing

A detergent composition prepared according to a conventional method was applied in an amount of 3 mL to the palm of a hand, and the quickness of foaming, amount of foam, quality of foam, and feel after washing the hands and arms were evaluated by a panel of 10 experts according to the following criteria:

(Quickness of Foaming)
- 4: very good
- 3: good
- 2: somewhat poor
- 1: poor (Amount of Foam)
- 4: very abundant
- 3: abundant
- 2: somewhat little
- 1: little (Quality of Foam)
- 4: fine and very creamy good foam
- 3: creamy good foam
- 2: somewhat creamy foam
- 1: light and rough foam (Feel After Washing)
- 4: very good
- 3: good
- 2: somewhat poor
- 1: poor Rank
- A: an average score of not less than 3.5
- B: an average score of not less than 2.5 but less than 3.5
- C: an average score of not less than 1.5 but less than 2.5
- D: an average score of less than 1.5

TABLE 1

| Component (wt. %) | | Example 1 | 2 | 3 | 4 | 5 | 6 | 7 | Comparative Example 1 | 2 | 3 |
|---|---|---|---|---|---|---|---|---|---|---|---|
| (A) Potassium lauryl phosphate | | 13.0 | 13.4 | 17.7 | 9.2 | 13.0 | 15.1 | 9.2 | 20.0 | 19.0 | 11.3 |
| Potassium myristyl phosphate | | | | | 4.3 | | | 4.3 | | | |
| ($B_1$) Potassium lauryloxyethyl phosphate (in formula (2), n = 1, $R^2$: lauryl, $X^2$: hydrogen atom, $Y^2$: potassium) | | 4.3 | 6.6 | 2.3 | 3.0 | 4.3 | 4.9 | 3.0 | | 1.0 | 8.7 |
| Potassium myristyloxyethyl phosphate (in formula (2), n = 1, $R^2$: myristyl, $X^2$: hydrogen atom, $Y^2$: potassium) | | | | | 1.4 | | | 1.4 | | | |
| ($B_2$) Potassium polyoxyethylene (2) lauryl phosphate*(in formula (2), n = 2, $R^2$: lauryl, $X^2$: hydrogen atom, $Y^2$: potassium) | | 2.7 | | | 2.2 | 2.7 | | 1.0 | | | |
| Molar ratio of (A)/($B_1$) | | 77.5/22.5 | 70/30 | 90/10 | 78/22 | 77.5/22.5 | 78/22 | 78/22 | 100/0 | 96/4 | 60/40 |
| Mol % in phosphate monoester | (A) | 69 | 70 | 90 | 69 | 69 | 78 | 69 | 100 | 96 | 60 |
| | ($B_1$) | 20 | 30 | 10 | 20 | 20 | 22 | 20 | 0 | 4 | 40 |
| | ($B_2$) | 11 | | | 11 | 11 | | 11 | | | |
| (D) 2-ethylhexylglyceryl ether | | | | | | 1.0 | 1.0 | 1.0 | | | |
| Purified water | | Balance | Balance | Balance | Balance | Balance | Balance | Balance | Balance | Balance | Balance |
| Water used; pH: from 5 to 8, hardness: 4° DH | | | | | | | | | | | |
| Quickness of foaming | | A | A | B | A | A | A | A | D | D | B |
| Amount of foam | | A | B | B | B | A | A | A | D | C | B |
| Quality of foam | | B | B | A | A | A | B | A | D | C | C |
| Feel after washing | | A | A | A | A | A | A | A | D | D | C |
| Water used; pH: from 4 to lower than 5, Hardness: 4° DH | | | | | | | | | | | |
| Quickness of foaming | | A | A | B | A | A | B | A | D | D | B |
| Amount of foam | | B | B | B | B | B | B | B | D | D | B |
| Quality of foam | | B | B | A | A | A | B | A | D | C | C |
| Feel after washing | | A | A | A | A | A | A | A | D | D | C |
| Water used; pH: from higher than 8 to 9, Hardness: 4° DH | | | | | | | | | | | |
| Quickness of foaming | | A | A | B | A | A | A | A | D | D | B |
| Amount of foam | | A | B | B | A | A | A | A | C | B | B |
| Quality of foam | | B | B | A | A | B | B | A | D | C | C |
| Feel after washing | | A | A | A | A | A | A | A | D | D | C |

*numeric value in parentheses denotes molar number of E0 added

TABLE 2

| Component (wt. %) | | Example 8 | 9 | Comparative Example 4 |
|---|---|---|---|---|
| (A) Potassium lauryl phosphate | | 13.0 | 9.2 | 20.0 |
| Potassium myristyl phosphate | | | 4.3 | |
| ($B_1$) Potassium lauryloxyethyl phosphate (in formula (2), n = 1, $R^2$: lauryl, $X^2$: hydrogen atom, $Y^2$: potassium) | | 4.3 | 3.0 | |
| Potassium myristyloxyethyl phosphate (in formula (2), n = 1, $R^2$: myristyl, $X^2$: hydrogen atom, $Y^2$: potassium) | | | 1.4 | |
| ($B_2$) Potassium polyoxyethylene (2) lauryl phosphate*(in formula (2), n = 2, $R^2$: lauryl, $X^2$: hydrogen atom, $Y^2$: potassium) | | 2.7 | 2.2 | |
| Molar ratio of (A)/($B_1$) | | 77.5/22.5 | 78/22 | 100/0 |
| Mol % in phosphate monoester | (A) | 69 | 69 | 100 |
| | ($B_1$) | 20 | 20 | 0 |
| | ($B_2$) | 11 | 11 | |
| (D) 2-ethylhexylglyceryl ether | | | 1.0 | |
| Purified water | | Balance | Balance | Balance |
| Water used; pH: from 5 to 8, hardness: 4° DH | | | | |
| Quickness of foaming | | A | A | D |
| Amount of foam | | B | A | D |
| Quality of foam | | B | A | D |
| Feel after washing | | A | A | D |

TABLE 2-continued

| Component (wt. %) | Example 8 | Example 9 | Comparative Example 4 |
|---|---|---|---|
| Water used; pH: from 4 to lower than 5, hardness: 15° DH | | | |
| Quickness of foaming | A | A | D |
| Amount of foam | B | B | D |
| Quality of foam | B | A | D |
| Feel after washing | A | A | D |
| Water used; pH: from higher than 8 to 9, hardness: 15° DH | | | |
| Quickness of foaming | A | A | D |
| Amount of foam | A | A | C |
| Quality of foam | B | A | C |
| Feel after washing | A | A | C |

*numeric value in parentheses denotes a molar number of E0 added

TABLE 3

| Component (wt. %) | Example 10 | Example 11 | Example 12 | Example 13 | Comparative Example 5 |
|---|---|---|---|---|---|
| (A) Potassium lauryl phosphate | 5.0 | 10.0 | | | 16.0 |
| Branched alkyl phosphate ester A*1 | | | 5.0 | | |
| Branched alkyl phosphate ester B*1 | | | | 10.0 | |
| (C) Potassium polyoxyethylene(1) lauryl Phosphate | 15.0 | | | | 4.0 |
| Potassium polyoxyethylene (2) lauryl Phosphate | | 10.0 | | | |
| Branched alkyl phosphate ester C*1 | | | 15.0 | | |
| Branched alkyl phosphate ester D*1 | | | | 10.0 | |
| Weight ratio of (A)/(C) | 25/75 | 50/50 | 25/75 | 50/50 | 80/20 |
| Purified water | Bal. | Bal. | Bal. | Bal. | Bal. |
| Water used; pH: from 5 to 8, hardness: 15° DH | | | | | |
| Quickness of foaming | A | A | A | A | D |
| Amount of foam | B | B | A | A | D |
| Quality of foam | A | B | B | C | D |
| Feel after washing | A | A | B | B | D |
| Water used; pH: from 4 to lower than 5, hardness: 15° DH | | | | | |
| Quickness of foaming | A | A | A | A | D |
| Amount of foam | B | B | A | A | D |
| Quality of foam | A | B | B | C | D |
| Feel after washing | A | A | B | B | D |
| Water used; pH: from higher than 8 to 9, hardness: 15° DH | | | | | |
| Quickness of foaming | A | A | A | A | C |
| Amount of foam | B | A | A | A | C |
| Quality of foam | A | B | C | C | D |
| Feel after washing | A | A | B | B | D |

*1: branched alkyl phosphate ester

| Branched alkyl phosphate ester | Raw material alcohol (R—0H) | Average number of carbon atom of R | Branching fraction of R(%) | Average molar number of E0 added (n) | Counter ion X1 | Counter Ion Y1 |
|---|---|---|---|---|---|---|
| A | Dobanol 23 *2 | 12.6 | 18 | 0 | K | H |
| B | Neodol 1 *3 | 11 | 18 | 0 | K | H |
| C | Dobanol 23 *2 | 12.6 | 18 | 1 | K | H |
| D | Neodol 1 *3 | 11 | 18 | 2 | K | H |

*2: product of Mitsubishi Chemical Corporation
*3: product of Shell companies

TABLE 4

| Component (wt. %) | Example 14 | Example 15 | Comparative Example 6 | Comparative Example 7 |
|---|---|---|---|---|
| Potassium polyoxyethylene(0.5)lauryl phosphate** | 15.0 | 15.0 | | |
| Potassium lauryl phosphate | | | 15.0 | |
| Potassium polyoxyethylene(2)lauryl phosphate** | | | | 15.0 |
| 2-ethylhexylglyceryl ether | | 1.0 | | |
| Purified water | Balance | Balance | Balance | Balance |
| Water used; pH: from 5 to 8, hardness: 15° DH | | | | |
| Quickness of foaming | A | A | D | B |
| Amount of foam | B | A | D | C |
| Quality of foam | B | B | D | D |
| Feel after washing | A | A | D | C |
| Water used; pH: from 4 to lower than 5, hardness: 15° DH | | | | |
| Quickness of foaming | B | A | D | B |
| Amount of foam | B | A | D | C |
| Quality of foam | B | B | D | D |
| Feel after washing | A | A | D | C |
| Water used; pH: from higher than 8 to 9, hardness: 15° DH | | | | |
| Quickness of foaming | A | A | D | B |
| Amount of foam | A | A | D | B |
| Quality of foam | B | B | D | D |
| Feel after washing | A | A | D | C |

**numeric value in parentheses denotes an average molar number of EO added

Example 16

Facial Wash

A facial wash was prepared according to the following formulation.

| | (part by wt.) |
|---|---|
| Potassium lauryl phosphate | 5 |
| Potassium polyoxyethylene(1)lauryl phosphate* | 15 |
| 2-ethylhexylglyceryl ether | 1.0 |
| Dipropylene glycol | 5 |
| Polyoxyethylene sorbitan triisostearate (EO: 160) | 2.0 |
| 4% Aqueous solution of N,N-dimethylaminoethyl methacrylic acid diethyl sulfate/N,N-dimethylacrylamide/polyethylene glycol dimethacrylate copolymer [SOFCARE KG-301W; product of Kao Corporation] | 5 |
| Lauryl hydroxysulfobetaine | 1 |
| Ethylene glycol distearate | 2 |
| Methyl parabene | 0.2 |
| Propyl parabene | 0.1 |
| BHT | 0.2 |
| Perfume | 0.05 |
| Purified water | balance |
| | 100.00 |

*N, an average molar number of EO added, is 1

Example 17

Body Shampoo

A body shampoo was prepared according to the following formulation.

| | (part by wt.) |
|---|---|
| Potassium lauryl phosphate | 5 |
| Potassium polyoxyethylene(1)lauryl phosphate* | 15 |
| 2-Ethylhexylglyceryl ether | 1.0 |
| Dipropylene glycol | 2.2 |
| Glycerine | 3.0 |
| Alkyl acrylate methacrylate copolymer a) | 0.2 |
| Cocamidopropyl betaine | 8.0 |
| Ethylene glycol distearate | 2.0 |
| Salicylic acid | 0.2 |
| BHT | 0.2 |
| Perfume | 0.05 |
| Purified water | balance |
| | 100.00 |

*N, an average molar number of EO added, is 1
a) Carbopol ETD2020; product of B.F. Goodrich corporation The facial wash and body shampoo of Examples 16 and 17, respectively, were excellent in foamability and quality of foam, and were also good in feel after use.

Example 18

Body Shampoo

A body shampoo was prepared according to the following formulation.

| | (part by wt.) |
|---|---|
| Potassium lauryl phosphate | 3.8 |
| Potassium polyoxyethylene(1)lauryl phosphate* | 11.2 |
| Decane-1,2-diol | 1.0 |
| Propylene glycol | 5 |
| Cationized cellulose (POIZ C-150L; product of Kao Corporation) | 0.3 |
| Lauryl hydroxysulfobetaine | 5 |
| Ethylene glycol distearate | 2 |
| Methyl parabene | 0.2 |
| Propyl parabene | 0.1 |
| BHT | 0.2 |
| Perfume | 0.05 |
| Purified water | balance |
| | 100.00 |

*N, an average molar number of EO added, is 1

Example 19

Body Shampoo

A body shampoo was prepared according to the following formulation.

| | (part by wt.) |
|---|---|
| Potassium lauryl phosphate | 5.0 |
| Potassium polyoxyethylene(1)lauryl phosphate* | 15.0 |

-continued

| | (part by wt.) |
|---|---|
| Octane-1,2-diol | 1.5 |
| Dipropylene glycol | 2.2 |
| Glycerine | 3.0 |
| Alkyl acrylate methacrylate copolymer a) | 0.2 |
| Cocamidopropyl betaine | 8.0 |
| Ethylene glycol distearate | 2.0 |
| Salicylic acid | 0.2 |
| BHT | 0.2 |
| Perfume | 0.05 |
| Purified water | balance |

*N, an average molar number of EO added, is 1
a) Carbopol ETD2020; product of B.F. Goodrich Corporation The body shampoos of Examples 18 and 19 were excellent in foamability and quality of foam, and were also good in feel after use.

Example 20

Facial Wash

A facial wash was prepared according to the following formulation.

| | (part by wt.) |
|---|---|
| Potassium lauryl phosphate | 5.0 |
| Potassium polyoxyethylene(1)lauryl phosphate* | 15.0 |
| 2-Ethylhexylglyceryl ether | 1.5 |
| Dipropylene glycol | 1.5 |
| Propylene glycol | 5.0 |
| Sorbitol | 5.0 |
| Potassium polyoxyethylene alkyl ether acetate (alkyl group: C12/C14 = 75/25, EO: 10) | 1.8 |
| Polyoxyethylene sorbitan triisostearate (EO: 160) | 2.0 |
| Cationized cellulose (POIZ C-150L; product of Kao Corporation) | 0.3 |
| Alkyl acrylate methacrylate copolymer b) | 0.5 |
| Lauryl hydroxysulfobetaine | 3.0 |
| Lauramidopropyl betaine | 2.0 |
| Ethylene glycol distearte | 2.0 |
| Methyl parabene | 0.2 |
| Propyl parabene | 0.1 |
| BHT | 0.2 |
| Perfume | 0.05 |
| Purified water | balance |
| | 100.00 |

*N, an average molar number of EO added, is 1
b) Carbopol ETD2020; product of B.F. Goodrich Corporation

Example 21

Facial Wash

A facial wash was prepared according to the following formulation.

| | (part by wt.) |
|---|---|
| Triethanol amine lauryl phosphate | 5 |
| Triethanol amine polyoxyethylene(1)lauryl phosphate* | 15 |
| 2-ethylhexylglyceryl ether | 0.7 |
| Triethanol amine myristate | 2.5 |
| Glycerine | 16 |
| Polyoxyethylene sorbitan triisostearate (EO: 160) | 2 |

-continued

| | (part by wt.) |
|---|---|
| 4% aqueous solution of N,N-dimethylaminoethyl methacrylic acid diethyl sulfate/N,N-dimethylacrylamide/polyethylene glycol dimethacrylate copolymer [SOFCARE KG-301W; product of Kao Corporation] | 12.5 |
| Alkyl acrylate methacrylate copolymer c) | 0.5 |
| Lauramidopropyl betaine | 4.0 |
| Methyl parabene | 0.2 |
| Propyl parabene | 0.1 |
| BHT | 0.2 |
| Purified water | balance |
| | 100.00 |

*N, an average molar number of EO added, is 1
c) Carbopol ETD2020; product of B.F. Goodrich Corporation The facial washes of Examples 20 and 21 were excellent in foamability and quality of foam, and were also good in feel after use.

The invention claimed is:

1. A detergent composition comprising components (A) and ($B_1$) in a molar ratio (A)/($B_1$), in a range of from 70/30 to 90/10:

(A) a phosphate monoester represented by formula (1), and ($B_1$) a phosphate monoester represented by formula (2),

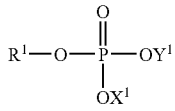

(1)

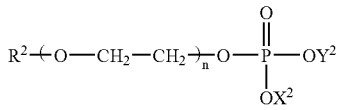

(2)

wherein, $R^1$ and $R^2$ may be the same or different and each represents a straight or branched alkyl or alkenyl group having 8 to 18 carbon atoms; $X^1$, $X^2$, $Y^1$ and $Y^2$ may be the same or different and each represents a hydrogen atom, an alkali metal atom, an alkaline earth metal atom, an alkanolamine or ammonium; and n, a molar number of ethylene oxide added, is an integer of 1.

2. A detergent composition comprising components (A), ($B_1$) and ($B_2$) in amounts of 35–80 molar % of component (A), 15–25 molar % of component ($B_1$) and 5–15 molar % of component ($B_2$) of the phosphate monoesters represented by formulas (1) and (2):

(A) a phosphate mono ester represented by formula (1), ($B_1$) a phosphate monoester represented by formula (2), wherein n is 1, and ($B_2$) a phosphate monoester represented by formula (2), wherein n is 2

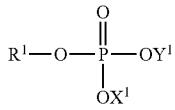

(1)

-continued (2)

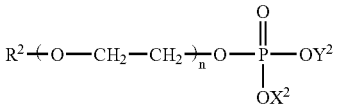

wherein, $R^1$ and $R^2$ may be the same or different and each represents a straight or branched alkyl or alkenyl group having 8 to 18 carbon atoms; $X^1$, $X^2$, $Y^1$ and $Y^2$ may be the same or different and each represents a hydrogen atom, an alkali metal atom, an alkaline earth metal atom, an alkanolamine or ammonium.

3. A detergent composition comprising components (A), ($B_1$) and ($B_2$) in amounts of 5–30 wt. % of component (A), 1–10 wt. % of ($B_1$) and 0.5–5 wt. % of ($B_2$) of the detergent composition:

(A) a phosphate monoester represented by formula (1), ($B_1$) a phosphate monoester represented by formula (2), wherein n is 1, and ($B_2$) a phosphate monoester represented by formula (2), wherein n is 2

(1)

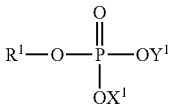

(2)

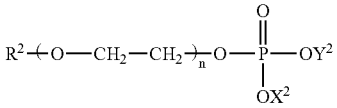

wherein, $R_1$ and $R_2$ may be the same or different and each represents a straight or branched alkyl or alkenyl group having 8 to 18 carbon atoms; $X^1$, $X^2$, $Y^1$ and $Y^2$ may be the same or different and each represents a hydrogen atom, an alkali metal atom, an alkaline earth metal atom, an alkanolamine or ammonium.

4. A detergent composition comprising components (A) and (C) in amounts of 5–60 parts by weight of component (A) and 40–95 parts by weight of component (C) of the total amount of components (A) and (C) which total is 100 parts by weight:

(A) a phosphate monoester represented by formula (1), and (C) a phosphate monoester represented by formula (3), (1)

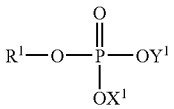

(3)

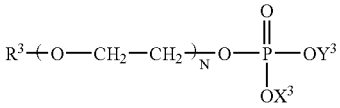

wherein, $R^1$ represents a straight or branched alkyl or alkenyl group having 12 to 18 carbon atoms and $R^3$ represents a straight or branched alkyl or alkenyl group having 8 to 18 carbon atoms; $X^1$, $X^3$, $Y^1$ and $Y^3$ may be the same or different and each represents a hydrogen atom, an alkali metal atom, an alkaline earth metal atom, an alkanolamine or ammonium; and N, an average molar number of ethylene oxide added, is a number of from 1 to 2.

5. The detergent composition according to any of claims 1 to 4, which further comprises a glyceryl ether having 4 to 12 carbon atoms.

6. The detergent composition according to any of claims 1 to 4, wherein a 20-fold diluted solution of the detergent composition has a pH in a range of from 4 to 8.

7. The detergent composition according to any of claims 1 to 4, wherein the detergent composition is used together with water having a hardness in a range of from 1 to 30° DH.

8. The detergent composition according to any of claims 1 to 4, wherein water to be used has a pH in a range of from 4 to 9.

9. The detergent composition according to any of claims 1 to 4, wherein said composition may further comprise a diester in a weight ratio of monoesters/diesters in the detergent composition of from 100/0 to 60/40.

10. The detergent composition according to claim 5, wherein the content of the glyceryl ether is 0.3 to 5% by weight of the detergent composition.

11. A process for preparing the detergent composition according to claim 4, which comprises steps of mixing 5 to 60 parts by weight of (A) a phosphate monoester represented by formula (1) obtained by reacting an aliphatic alcohol represented by formula (4) with at least one phosphorylating agent selected from phosphoric acid, polyphosphoric acid and $P_2O_5$, and 40 to 95 parts by weight of (C) a polyoxyethylene phosphate monoester represented by formula (3) obtained by adding ethylene oxide to an aliphatic alcohol represented by formula (5) to give an ethoxylate having an average molar number of ethylene oxide added of 1 to 2 and reacting the ethoxylate with at least one phosphorylating agent selected from phosphoric acid, polyphosphoric acid and $P_2O_5$, and then neutralizing the resulting mixture with an alkali:

(1)

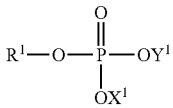

(3)

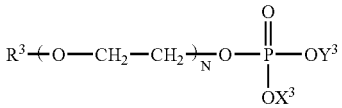

$R^1OH$ (4)

$R^3OH$ (5)

wherein, $R^1$, $R^3$, $X^1$, $X^3$, $Y^1$, $Y^3$ and N are as defined above.

12. A method of washing a body which comprises applying to the body to be washed the detergent composition according to any of claims 1 to 4.

* * * * *